US011383903B1

(12) United States Patent
Gayle et al.

(10) Patent No.: US 11,383,903 B1
(45) Date of Patent: Jul. 12, 2022

(54) BEVERAGE COVER ALARM

(71) Applicants: Sherifa Gayle, Pikesville, MD (US); Nikos Montesatos, Pikesville, MD (US)

(72) Inventors: Sherifa Gayle, Pikesville, MD (US); Nikos Montesatos, Pikesville, MD (US)

( * ) Notice: Subject to any disclaimer, the term of this patent is extended or adjusted under 35 U.S.C. 154(b) by 1023 days.

(21) Appl. No.: 16/043,272

(22) Filed: Jul. 24, 2018

(51) Int. Cl.
*B65D 51/24* (2006.01)
*A47G 19/22* (2006.01)

(52) U.S. Cl.
CPC ..... *B65D 51/248* (2013.01); *A47G 19/2227* (2013.01); *A47G 2019/2238* (2013.01)

(58) Field of Classification Search
CPC ..... A47G 19/2227; A47G 2019/2238; B65D 55/028
See application file for complete search history.

(56) References Cited

U.S. PATENT DOCUMENTS 445,755 A 2/1891 King
4,832,217 A 5/1989 Lin
6,382,416 B1 5/2002 Gainey
8,237,541 B2 8/2012 Wang
2005/0097931 A1 5/2005 Miller
2008/0302794 A1 12/2008 Wagner
2015/0359365 A1 12/2015 Feeley

FOREIGN PATENT DOCUMENTS

DE 102008036488 A1 * 2/2010 ..... B65D 5/4291
WO 2011028845 3/2011

* cited by examiner

*Primary Examiner* — Robert J May
(74) *Attorney, Agent, or Firm* — Kyle A. Fletcher, Esq.

(57) ABSTRACT

The beverage cover alarm is a lid for a beverage container that protects the beverage in the container from being tampered with. When the user must leave the beverage unattended, they place the lid onto the container and the lid uses one or more pressure sensors that are in contact with the rim of the container to detect removal. The lid comprises one or more LEDs that visually report that the beverage cover alarm is protecting the beverage or that the lid has been removed. Once the lid is removed a tampering warning is presented visually and the tampering warning cannot be reset without pressing a designated finger of the user against a fingerprint scanner located on the top of the lid.

17 Claims, 3 Drawing Sheets

BEVERAGE COVER ALARM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal safety, more specifically, a beverage cover alarm.

Summary of Invention

The beverage cover alarm is a lid for a beverage container that protects the beverage in the container from being tampered with. When the user must leave the beverage unattended, they place the lid onto the container and the lid uses one or more pressure sensors that are in contact with the rim of the container to detect removal. The lid comprises one or more LEDs that visually report that the beverage cover alarm is protecting the beverage or that the lid has been removed. Once the lid is removed a tampering warning is presented visually and the tampering warning cannot be reset without pressing a designated finger of the user against a fingerprint scanner located on the top of the lid.

An object of the invention is to provide a lid for a beverage container that detects and reports tampering in the form of removal of the lid.

Another object of the invention is to detect removal of the lid using one or more pressure sensor in contact with the rim of the container.

A further object of the invention is to report that the lid is protecting the beverage or has detected tampering by visually changing the state of one or more LEDs.

Yet another object of the invention is to allow the tampering warning to be reset only upon presentation of the user's fingerprint at a fingerprint scanner on the top of the lid.

These together with additional objects, features and advantages of the beverage cover alarm will be readily apparent to those of ordinary skill in the art upon reading the following detailed description of the presently preferred, but nonetheless illustrative, embodiments when taken in conjunction with the accompanying drawings.

In this respect, before explaining the current embodiments of the beverage cover alarm in detail, it is to be understood that the beverage cover alarm is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the beverage cover alarm.

It is therefore important that the claims be regarded as including such equivalent construction insofar as they do not depart from the spirit and scope of the beverage cover alarm. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
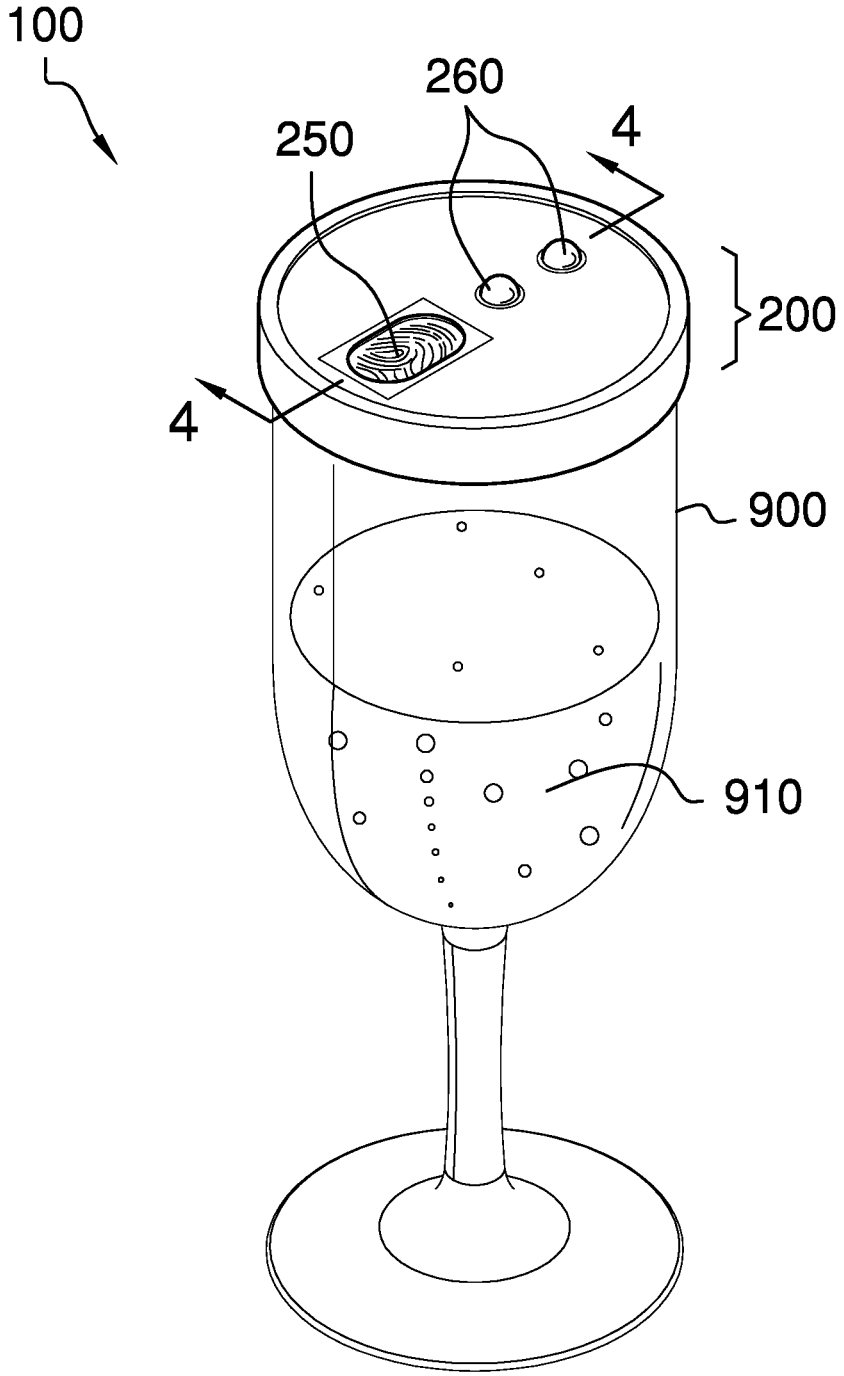
FIG. 1 is a perspective view of an embodiment of the disclosure.
Figure 2:
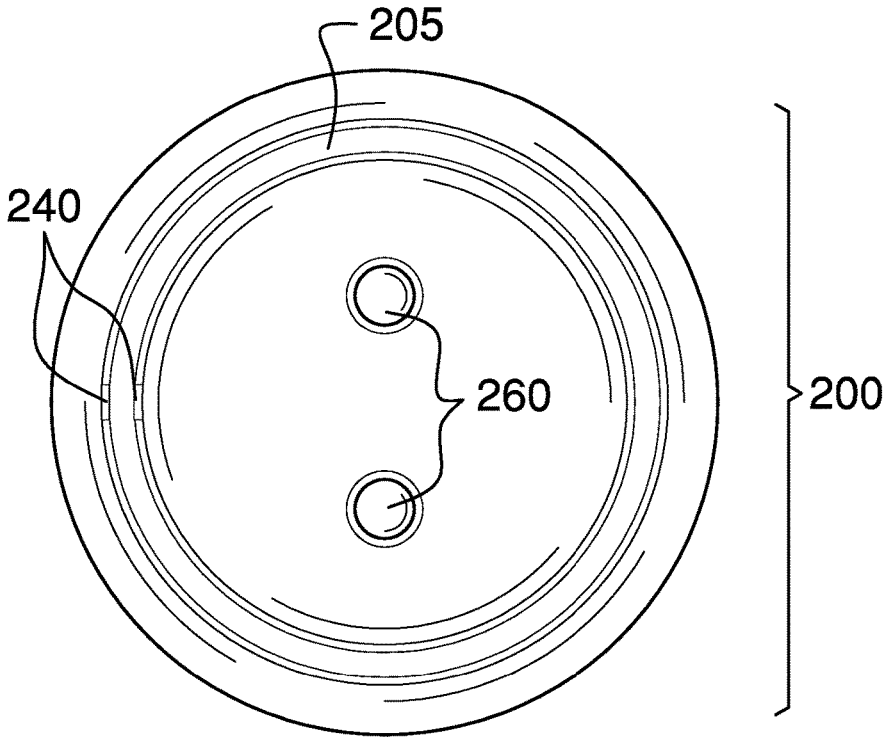
FIG. 2 is a bottom view of an embodiment of the disclosure.
Figure 3:
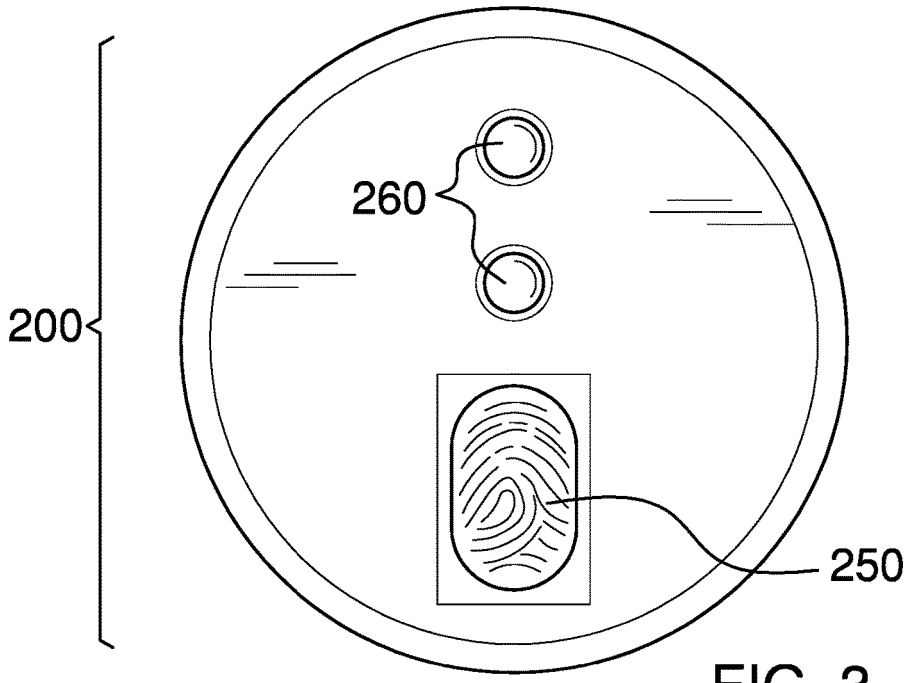
FIG. 3 is a top view of an embodiment of the disclosure.
Figure 4:
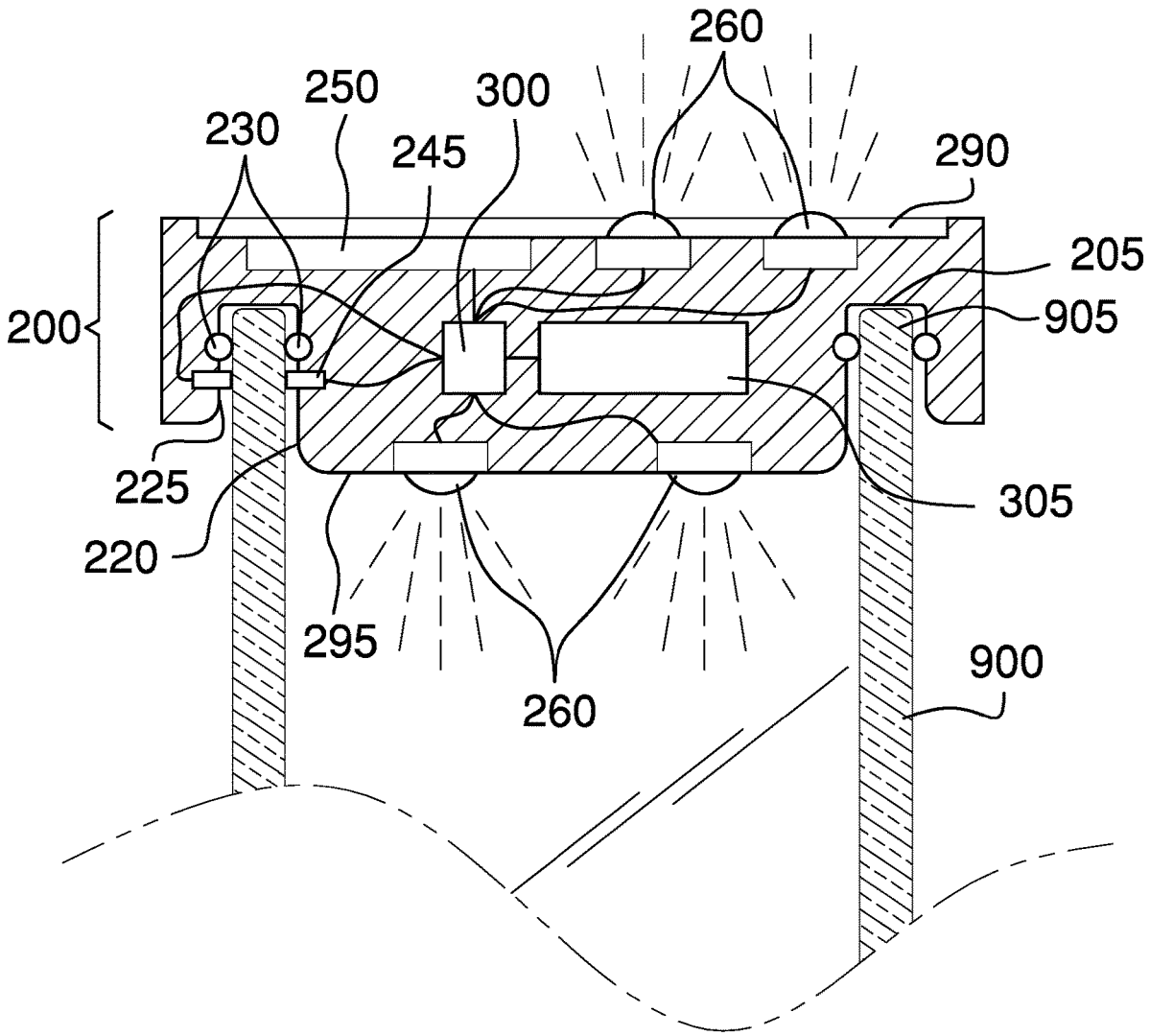
FIG. 4 is a cross-sectional view of an embodiment of the disclosure across 4-4 as shown in FIG. 1.

Detailed reference will now be made to a first potential embodiment of the disclosure, which is illustrated in FIGS. 1 through 4.

The beverage cover alarm 100 (hereinafter invention) comprises a lid 200, one or more grooves 205, one or more pressure sensors 240, a fingerprint scanner 250, one or more LED lights 260, a processor 300, and a battery 305. The lid 200 is placed on the top of a beverage container 900 which is going to be left unattended. The invention 100 may be adapted to provide a warning if the lid 200 is removed by an unauthorized person. As a non-limiting example, if a user is in a bar and must use a restroom, the user may place the lid 200 on their the beverage container 900, which will activate the invention 100. When the user returns, they will be able to visually detect if the lid 200 has been removed. If the invention 100 indicates that the lid 200 has been removed while the user was away, the user should suspect that a beverage 910 in the beverage container 900 has been tampered with, the beverage container 900 should be discarded, and a new beverage should be ordered.

The lid 200 may be a disk-shaped covering for the beverage container 900. The fingerprint scanner 250 may be located on a top surface 290 of the lid 200. The one or more grooves 205 may be located on a bottom surface 295 of the lid 200.

The one or more grooves 205 may be circular. The one or more grooves 205 may be concentric if there are at least two of the one or more grooves 205. Providing more than one groove may allow the lid 200 to be used on containers of different sizes.

An individual groove selected from the one or more grooves 205 may comprise a pair of O-rings 230 located on an inside wall 220 and on an outside wall 225 of the individual groove. The pair of O-rings 230 may compress against a rim 905 of the beverage container 900 that is inserted into the individual groove. The compression of the pair of O-rings 230 against the rim 905 of the beverage container 900 may prevent any liquid, powder, gas, or other material from entering or exiting from the beverage container 900. The compression of the pair of O-rings against the rim 905 of the beverage container 900 may assist in retaining the lid 200 on the rim 905 of the beverage container 900.

The individual groove may comprise the one or more pressure sensors 240. An individual pressure sensor 245 selected from the one or more pressure sensors 240 may be a pressure sensitive switch that makes or break an electrical circuit based upon whether the rim 905 of the beverage container 900 is inserted into the individual groove where the individual pressure sensor 245 is located. The individual pressure sensor 245 may be located on the inside wall 220 of the individual groove, on the outside wall 225 of the individual groove, or both.

The fingerprint scanner 250 may be a biometric fingerprint scanner or reader. The fingerprint scanner 250 may be adapted to determine a fingerprint associated with a designated finger that is placed onto the fingerprint scanner 250. In some embodiments, the fingerprint scanner 250 may compare the fingerprint with a stored fingerprint located within the fingerprint scanner 250 and report a match/no match status to the processor 300. The stored fingerprint may be acquired by the fingerprint scanner 250 during a training procedure.

The one or more LED lights 260 may be located on the top surface 290 of the lid 200, on the bottom surface 295 of the lid 200, or both. The illumination state and color of the one or more LED lights 260 may indicate an operational state of the invention 100.

The one or more LED lights 260 may be extinguished to indicate that the operational state of the invention 100 is QUIESCENT. As a non-limiting example, the lid 200 that is not installed on the top of the beverage container 900 and is not protecting the beverage 910 may be in the operational state of QUIESCENT.

The one or more LED lights 260 may illuminate and present a first color to indicate that the operational state is PROTECTING. As a non-limiting example, the invention 100 may enter the operational state of PROTECTING when the one or more pressure sensors 240 signals the processor 300 that the lid 200 has been placed onto the rim 905 of the beverage container 900 and therefore the invention 100 is protecting the beverage 910 located within the beverage container 900.

The operational state of the invention 100 may be adapted to transition from PROTECTING to QUIESCENT when the user places the designated finger onto the fingerprint scanner 250 to indicate that they have returned to their seat and that they are in control of the integrity of the beverage 910 located within the beverage container 900.

The one or more LED lights 260 may illuminate and present a second color to indicate that the operational state is WARNING. As a non-limiting example, the invention 100 may enter the operational state of WARNING when the one or more pressure sensors 240 indicate that the lid 200 has been removed from the beverage container 900 without first using the fingerprint scanner 250 to transition to the operational state of QUIESCENT.

When the invention 100 is in the operational state of WARNING, it may be adapted to remain in that state until the designated finger is placed onto the fingerprint scanner 250. This assures that the lid 200 will not be placed back onto the beverage container 900 after being removed.

The first color may be blue, green, or a combination thereof. The second color may be red. Some or all of the one or more LED lights 260 may blink when in the operational state of PROTECTING or when in the operational state of WARNING.

The processor 300 may be adapted to establish the stored fingerprint for the designated finger to use in later comparisons by completing the training procedure. As a non-limiting example, the training procedure may be adapted to require pressing the designated finger against the fingerprint scanner 250 for a predetermined amount of time when the lid 200 has no previously learned fingerprint recorded. In some embodiments, the stored fingerprint may be erased so that the fingerprint may be re-learned by following an erase procedure. As a non-limiting example, the erase procedure may require execution of a specific sequence of placing and removing the lid 200 on the beverage container 900 for predetermined periods of time where the specific sequence and timing is unique to each of the lids 200. This sequence and timing would therefore be a secret and would be unknown by the unauthorized person.

The invention 100 may comprise the processor 300 and a memory wherein the memory contains instructions for causing the processor 300 to control the sequence and timing of changes in the operational state of the invention 100. The memory and input/output ports may be integral to the processor 300 such that the processor 300 may execute a program and access the one or more LED lights 260, the fingerprint scanner 250, and the one or more pressure sensors 240 without requiring additional components.

The battery 305 may comprise one or more energy-storage devices. The battery 305 may be a source of electrical energy to operate the processor 300, the one or more LED lights 260, and the one or more pressure sensors 240. The battery 305 may be replaceable or rechargeable.

In use, the users completes the training procedure so that the invention 100 recognizes the fingerprint of the designated finger. If the user is in a public place and must leave the beverage container 900 unattended to visit the restroom, they may first place the invention 100 on the beverage container 900. Initially, the operational state of the invention 100 will be QUIESCENT and the operational state will transition to PROTECTING when the processor 300 senses, using the one or more pressure sensors 240, that the lid 200 has been placed on the rim 905 of the beverage container 900.

While the operational state of the invention 100 is PROTECTING, the one or more LED lights 260 will be illuminated in the first color. When the user returns to the beverage 910, if the one or more LED lights 260 are still illuminated in the first color then the lid 200 has not been removed and the beverage 910 should be safe. In that case, the user may press the designated finger against the fingerprint scanner 250 to change the operational state to QUIESCENT and then remove the lid 200 from the beverage container 900.

If the unauthorized person attempts to tamper with the beverage 910 by, as a non-limiting example, adding a drug to the beverage 910, the invention 100 will detect, using the one or more pressure sensors 240, the moment that the unauthorized person removes the lid 200 and the invention 100 will transition to WARNING. The operational state of the invention 100 will remain WARNING even if the unauthorized person attempts to replace the lid 200 or press their finger against the fingerprint scanner 250. The user will find the one or more LED lights 260 illuminated in the second color when they return and the user should suspect that the lid 200 has been removed and replaced. In that case, the beverage 910 should be considered tampered with and should be discarded. When the operational state of the invention 100 is WARNING, the user may reset the operational state to QUIESCENT so that the invention 100 may be used again by pressing the designated finger against the fingerprint scanner 250.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts, which may not be illustrated in the figures.

As used in this disclosure, a "beverage" is a liquid that is intended for consumption by a person.

In this disclosure, "compress" refers to forcing into a smaller space.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the term "designated finger" refers to a finger that a user intends to use for the purpose of locking and/or unlocking a device using a fingerprint reader or fingerprint scanner. Use of a designated finger may require a training mode where the designated finger is presented and scanned and the biometric signature of the designated finger is saved for later comparison.

As used in this disclosure, a "disk" is a cylindrically shaped object that is flat in appearance. A disk generally has a thickness (as measured from flat side to flat side) that is less than the radius of the cylinder.

As used herein, a "fingerprint scanner" or "fingerprint reader" is a biometric device that obtains a fingerprint from a finger placed on the device and encodes the fingerprint into a dataset representing the fingerprint. The device may transmit the dataset representing the fingerprint to another device, may compare the dataset representing the fingerprint with one or more stored datasets representing fingerprints and report any match, or both.

As used in this disclosure, an "LED" is an acronym for a light emitting diode. An LED allows current to flow in one direction and when current is flowing the LED emits photons. The wavelength of the light that is emitted may be in the visible range of the spectrum or may extend into either the infrared (IR) spectral range or the ultraviolet (UV) spectral range. The brightness of the LED can be increased and decreased by controlling the amount of current flowing through the LED. Multiple LEDs having different emission spectrums may be packaged into a single device to produce a multi-color LED. A broad range of colors may be produced by multi-color LEDs by selecting which of the multiple LEDs are energized and by controlling the brightness of each of the multiple LEDs. Organic LEDs (OLEDs) are included in this definition.

As used in this disclosure, a "lid" is a movable or removable cover that is placed on a hollow structure to contain and/or protect the contents within the hollow structure.

As used herein, the terms "processor", "central processor", "central processing unit", "CPU", or "microprocessor" refer to a digital device that carries out the instructions comprising a computer program by performing basic arithmetic, logical, control, and input/out operations. The term "microprocessor" may additionally imply a level of miniaturization and power reduction that makes the device suitable for portable or battery operated systems.

As used in this disclosure, a "rim" is an outer edge or border that follows along the perimeter of an object.

As used in this disclosure, a "sensor" is a device that quantitatively measures a physical stimulus.

As used in this disclosure, a "switch" is an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A beverage cover alarm comprising:

a lid, one or more grooves, one or more pressure sensors, a fingerprint scanner, one or more LED lights, a processor, and a battery;

wherein the lid is placed on the top of a beverage container which is going to be left unattended;

wherein the beverage cover alarm is adapted to provide a warning if the lid is removed by an unauthorized person;

wherein the lid is a disk-shaped covering for the beverage container;

wherein the fingerprint scanner is located on a top surface of the lid;

wherein the one or more grooves are located on a bottom surface of the lid;

wherein the one or more grooves are circular;

wherein the one or more grooves are concentric if there are at least two of the one or more grooves;

wherein an individual groove selected from the one or more grooves comprises a pair of O-rings located on an inside wall and on an outside wall of the individual groove;

wherein the pair of O-rings compress against a rim of the beverage container that is inserted into the individual groove;

wherein the compression of the pair of O-rings against the rim of the beverage container prevents any liquid, powder, gas, or other material from entering or exiting from the beverage container;

wherein the compression of the pair of O-rings against the rim of the beverage container assists in retaining the lid on the rim of the beverage container.

2. The beverage cover alarm according to claim 1 wherein the individual groove comprises the one or more pressure sensors;

wherein an individual pressure sensor selected from the one or more pressure sensors is a pressure sensitive switch that makes or break an electrical circuit based upon whether the rim of the beverage container is inserted into the individual groove where the individual pressure sensor is located;

wherein the individual pressure sensor is located on the inside wall of the individual groove, on the outside wall of the individual groove, or both.

3. The beverage cover alarm according to claim 2 wherein the fingerprint scanner is a biometric fingerprint scanner or reader;

wherein the fingerprint scanner is adapted to determine a fingerprint associated with a designated finger that is placed onto the fingerprint scanner;

wherein the fingerprint scanner compares the fingerprint with a stored fingerprint located within the fingerprint scanner and report a match/no match status to the processor;

wherein the stored fingerprint is acquired by the fingerprint scanner during a training procedure.

4. The beverage cover alarm according to claim 2 wherein the one or more LED lights are located on the top surface of the lid, on the bottom surface of the lid, or both;

wherein the illumination state and color of the one or more LED lights indicates an operational state of the beverage cover alarm.

5. The beverage cover alarm according to claim 4 wherein the lid that is not installed on the top of the beverage container and is not protecting a beverage is in the operational state of QUIESCENT;

wherein the one or more LED lights are extinguished to indicate that the operational state of the beverage cover alarm is QUIESCENT.

6. The beverage cover alarm according to claim 5 wherein the beverage cover alarm enters the operational state of PROTECTING when the one or more pressure sensors signals the processor that the lid has been placed onto the rim of the beverage container and therefore the beverage cover alarm is protecting the beverage located within the beverage container;

wherein the one or more LED lights illuminate and present a first color to indicate that the operational state is PROTECTING.

7. The beverage cover alarm according to claim 6 wherein the operational state of the beverage cover alarm is adapted to transition from PROTECTING to QUIESCENT when a user places the designated finger onto the fingerprint scanner to indicate that they have returned to their seat and that they are in control of the integrity of the beverage located within the beverage container.

8. The beverage cover alarm according to claim 7 wherein the beverage cover alarm enters the operational state of WARNING when the one or more pressure sensors indicate that the lid has been removed from the beverage container without first using the fingerprint scanner to transition to the operational state of QUIESCENT;

wherein the one or more LED lights illuminate and present a second color to indicate that the operational state is WARNING.

9. The beverage cover alarm according to claim 8 wherein when the beverage cover alarm is in the operational state of WARNING, it is adapted to remain in that state until the designated finger is placed onto the fingerprint scanner to assure that the lid will not be placed back onto the beverage container after being removed.

10. The beverage cover alarm according to claim 9 wherein the first color is blue, green, or a combination thereof;

wherein the second color is red.

11. The beverage cover alarm according to claim 9 wherein some or all of the one or more LED lights blink when in the operational state of PROTECTING or when in the operational state of WARNING.

12. The beverage cover alarm according to claim 9 wherein the processor is adapted to establish the stored fingerprint for the designated finger to use in later comparisons by completing the training procedure.

13. The beverage cover alarm according to claim 12 wherein the training procedure is adapted to require pressing the designated finger against the fingerprint scanner for a predetermined amount of time when the lid has no previously learned fingerprint recorded.

14. The beverage cover alarm according to claim 12 wherein the stored fingerprint is erased by following an erase procedure.

15. The beverage cover alarm according to claim 14 wherein the erase procedure requires execution of a specific sequence of placing and removing the lid on the beverage container for predetermined periods of time where the specific sequence and timing is unique to each of the lids.

16. The beverage cover alarm according to claim 12 wherein the beverage cover alarm comprises the processor and a memory wherein the memory contains instructions for causing the processor to control the sequence and timing of changes in the operational state of the beverage cover alarm.

17. The beverage cover alarm according to claim 16 wherein the battery comprises one or more energy-storage devices;

wherein the battery is a source of electrical energy to operate the processor, the one or more LED lights, and the one or more pressure sensors;

wherein the battery is replaceable or rechargeable.

* * * * *